US009066180B2

(12) United States Patent
Zoellin et al.

(10) Patent No.: US 9,066,180 B2
(45) **Date of Patent: *Jun. 23, 2015**

(54) COMPONENT HAVING A MICROMECHANICAL MICROPHONE STRUCTURE

(71) Applicant: Robert Bosch GmbH, Stuttgart (DE)

(72) Inventors: Jochen Zoellin, Muellheim (DE); Christoph Schelling, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 35 days.

This patent is subject to a terminal disclaimer.

(21) Appl. No.: 13/787,272

(22) Filed: Mar. 6, 2013

(65) Prior Publication Data

US 2013/0243234 A1 Sep. 19, 2013

(30) Foreign Application Priority Data

Mar. 13, 2012 (GB) ..... 10 2012 203 900

(51) Int. Cl.

| | |
|---|---|
| ***H04R 25/00*** | (2006.01) |
| ***H04R 1/08*** | (2006.01) |
| ***H04R 19/04*** | (2006.01) |
| *H04R 19/00* | (2006.01) |

(52) U.S. Cl.
CPC ..... *H04R 1/08* (2013.01); *H04R 19/005* (2013.01); *H04R 19/04* (2013.01)

(58) Field of Classification Search
CPC .... H04R 19/00; H04R 19/013; H04R 19/016; H04R 19/02; H04R 19/04; H04R 31/00; H04R 31/006; H04R 2201/00; H04R 2201/003; H04R 19/005; H04R 17/02; H04R 1/04; H04R 1/222; H04R 1/406; H04R 3/06; H04R 9/08; B81B 2201/0257; B81B 7/0061
USPC ..... 381/174, 175, 116, 113, 369; 367/178, 367/181, 188, 163, 174; 438/53; 29/594; 181/157, 171
See application file for complete search history.

(56) References Cited

U.S. PATENT DOCUMENTS

| | | | | |
|---|---|---|---|---|
| 6,535,460 | B2 * | 3/2003 | Loeppert et al. | 367/181 |
| 2007/0222006 | A1 * | 9/2007 | Weber et al. | 257/414 |

* cited by examiner

*Primary Examiner* — Curtis Kuntz
*Assistant Examiner* — Sunita Joshi
(74) *Attorney, Agent, or Firm* — Kenyon & Kenyon LLP

(57) ABSTRACT

A micromechanical microphone structure configured as a layered structure includes: a semiconductor substrate; a diaphragm structure having an acoustically active diaphragm which at least partially spans a sound opening in the back side of the substrate and is provided with a movable electrode of a microphone capacitor, which diaphragm structure has openings via which pressure compensation occurs between the back side and the front side of the diaphragm; a stationary acoustically permeable counterelement having vents, which counterelement is situated in the layered structure above the diaphragm and which functions as a carrier for a nonmovable electrode of the microphone capacitor; and at least one ridge-like structural element which is situated at the outer edge area of the diaphragm, and which protrudes from the diaphragm plane into corresponding recesses in an adjoining layer.

10 Claims, 3 Drawing Sheets

COMPONENT HAVING A MICROMECHANICAL MICROPHONE STRUCTURE

BACKGROUND OF THE INVENTION

1. Field of the Invention

The present invention relates to a component having a micromechanical microphone structure which is implemented in a layered structure on a semiconductor substrate. The microphone structure includes a diaphragm structure having an acoustically active diaphragm which at least partially spans a sound opening in the back side of the substrate. The diaphragm is provided with a movable electrode of a microphone capacitor. In addition, openings are provided in the diaphragm structure, via which pressure compensation occurs between the back side and the front side of the diaphragm. Moreover, the microphone structure includes a stationary acoustically permeable counterelement having vents, which is situated in the layered structure above the diaphragm and which functions as a carrier for a nonmovable electrode of the microphone capacitor.

2. Description of the Related Art

The diaphragm of the type described above is acted on by sound via the sound opening in the substrate and/or via through openings in the counterelement. The resulting diaphragm deflections are detected as fluctuations in the capacitance of the microphone capacitor.

However, the diaphragm structure responds not only to sound pressure, but also to fluctuations in the ambient pressure and to pressure fluctuations caused by air flow, for example from wind. These types of interfering influences on the microphone signal may be reduced by a slow pressure compensation between the two sides of the diaphragm. This pressure compensation takes place via flow paths between the vents in the counterelement and the sound opening. The speed of such a pressure compensation depends essentially on the flow resistance of the flow paths. The smaller the flow resistance, the more quickly a pressure compensation between the front side and the back side of the diaphragm is completed, and the less influence atmospheric pressure fluctuations and air flows have on the microphone signal. However, the sensitivity of the microphone to low-frequency acoustic signals is also reduced. In addition, the pressure on the diaphragm due to thermal noise increases.

The flow resistance during the pressure compensation between the front side and the back side of the diaphragm should thus be adjusted according to the sought frequency range of the microphone component.

A microphone component of the type mentioned at the outset is described in U.S. Pat. No. 6,535,460 B2. The design of this microphone component includes a substrate having a through opening which functions as a sound opening and is spanned by a diaphragm. A perforated counterelement is situated above the diaphragm and at a distance therefrom, and is connected to the substrate at the edge area of the sound opening. The diaphragm and counterelement together form a microphone capacitor, the diaphragm functioning as a movable electrode, while the stationary counterelement is provided with a rigid counter electrode.

In the known microphone component, a ring-shaped support structure for the diaphragm is provided above the edge area of the sound opening, at the underside of the stationary counterelement facing the diaphragm, which is used for the acoustic seal. For this purpose, the diaphragm is electrostatically attracted to the support structure. Although the perforation openings in the counterelement closest to the support structure also contribute to the pressure compensation between the front side and the back side of the diaphragm, the pressure compensation here occurs primarily via openings in the counterelement and in the diaphragm structure which are situated outside the area surrounded by the support structure, and which together with the air gap between the counterelement, the diaphragm structure, and the substrate form a flow path to the sound opening. The flow resistance is a function, on the one hand, of the distance between the pressure compensation openings and the acoustic seal, and on the other hand, of the width of the gap between the counterelement, the diaphragm structure, and the substrate. Manufacturing-related tolerances in the gap width frequently occur in a range which greatly influences the flow resistance.

BRIEF SUMMARY OF THE INVENTION

In the present invention, measures are proposed for achieving a slow pressure compensation between the front side and the back side of the diaphragm of a MEMS microphone component, which may be implemented using standard processes in semiconductor structuring, largely independently of the chip surface area of the component. These measures allow cost-effective implementation of microphone components with an improved signal-to-noise ratio (SNR).

According to the present invention, for this purpose the diaphragm of the microphone component is equipped with at least one ridge-like structural element which emerges from the diaphragm plane. This ridge-like structural element is situated at the outer edge area of the diaphragm, and protrudes, even during sound-related diaphragm deflections, into a corresponding recess in the layer on the other side of the air gap adjoining the particular diaphragm surface, without hindering the sound-related diaphragm deflections.

The diaphragm structure of the microphone component according to the present invention is thus interlocked with at least one adjoining stationary layer of the layered structure via the at least one ridge-like structural element. Since a direct pressure compensation between the front side and the back side of the diaphragm is prevented in this way, the ridge-like structural element forms an acoustic seal. For the slow pressure compensation via openings in the counterelement and in the diaphragm structure, flow must occur around the at least one ridge-like structural element. The length of the flow path may thus be easily varied via the size, shape, configuration, and number of the ridge-like structural elements. The chip surface area remains unchanged, since the flow path extends into the depth of the layered structure, not laterally. The flow resistance may thus be influenced in a targeted manner in a relatively large range, independently of the chip surface area, in order to achieve a certain microphone characteristic.

In principle, there are various options for implementing a microphone component according to the present invention, in particular with regard to the shape, extension, number, and orientation of the ridge-like structural elements.

A ridge-like structural element corresponding to the present invention may be easily implemented in the form of an extension which protrudes essentially perpendicularly from the diaphragm surface and has an essentially two-dimensional extent. This means that the width of the extension is very small in relation to its length, i.e., the progression on the diaphragm plane, and in relation to its height, i.e., the extension perpendicular to the diaphragm plane. The cross-sectional shape of the extension is determined essentially by the manufacturing method, i.e., the structuring process. Such a ridge-like structural element may, for example, be uniform over its entire height. However, with regard to good interlocking with diaphragm movement which is unhindered to the greatest extent possible, at least beyond a certain structure height, it has proven to be advantageous for the ridge-like structural element to taper with increasing distance from the diaphragm plane.

In principle, ridge-like structural elements may be formed on both surfaces of the diaphragm of a microphone component according to the present invention. Ridge-like structural elements on the side of the diaphragm facing the counterelement advantageously protrude into correspondingly shaped pressure compensation openings in the counterelement, while ridge-like structural elements on the side of the diaphragm facing the sound opening generally protrude into correspondingly shaped trench-like recesses in the substrate.

In preferred specific embodiments of the microphone component according to the present invention, the ridge-like structural elements on the diaphragm surface are not used just for the acoustic seal and for achieving a defined flow resistance for the pressure compensation between the two sides of the diaphragm. In addition, at least a portion of the ridge-like structural elements functions here as overload protection for the diaphragm structure. In the case of a ridge-like structural element on the side of the diaphragm facing the counterelement, the overload protection is implemented solely in the form of a section of the ridge-like structural element, which then protrudes into a trench-like recess in the counterelement and forms a stop for the ridge-like structural element. The diaphragm deflection in the direction of the counterelement may thus be easily limited. In the case of a ridge-like structural element on the side of the diaphragm facing the sound opening, the corresponding recess in the substrate is advantageously designed in such a way that it is also used as a stop for the ridge-like structural element.

A particularly effective acoustic seal may be achieved with the aid of a ridge-like structural element in the form of a closed circumferential wall situated above the edge area of the sound opening and at a lateral distance from the sound opening. The acoustic sealing effect here is independent of the orientation of the wall. That is, the acoustic sealing effect occurs regardless of whether the wall is situated on the diaphragm surface facing the counterelement or on the surface facing the sound opening. In both cases, the contribution of the vents in the counterelement above the diaphragm area to the pressure compensation is greatly reduced, which has a positive effect on the SNR of the microphone component.

In another advantageous specific embodiment of the present invention, the microphone component includes multiple ridge-like structural elements, each of which is implemented in the form of a section of a wall situated above the edge area of the sound opening and at a distance therefrom. In this case, the ridge-like structural elements are arrayed in such a way that together they form a circumferential wall, but with gaps between the individual structural elements. The acoustic sealing effect and the flow resistance of this type of configuration of ridge-like structural elements depend on the number of the arrayed structural elements and the size of the gaps between the structural elements, and may be influenced in a targeted manner via these parameters.

In one refinement of this specific embodiment of the present invention, the ends of the wall sections surrounding the sound opening are oriented toward the sound opening, so that the neighboring ends of two adjacent wall sections in each case form a flow channel which is oriented radially with respect to the diaphragm. In this embodiment variant, the flow resistance for the pressure compensation between the front side and the back side of the diaphragm may be further influenced by the number, length, and width of these radial flow channels.

At this point it is expressly pointed out that the diaphragm of a microphone component according to the present invention may also be equipped with multiple structural element formations which surround the sound opening. Thus, for example, two closed circumferential walls may be provided which are situated concentrically with respect to one another on the same diaphragm surface, or which also protrude from the front side and the back side of the diaphragm. Another option is to combine multiple perforated circumferential walls which are concentrically situated with respect to one another in such a way that the gaps in one circumferential wall are in each case positioned with an offset relative to the gaps in the adjacent wall(s). In this case as well, the individual wall sections of the circumferential walls may be provided either on the same diaphragm surface or on the front side and the back side of the diaphragm. Lastly, it is noted that one or multiple closed circumferential wall(s) may be combined with one or multiple perforated circumferential wall(s) in order to improve the acoustic seal between the front side and the back side of the diaphragm.

The performance of the microphone component according to the present invention is particularly good when the vents in the counterelement are situated solely in the center region above the diaphragm area which is surrounded by the circumferential wall or the wall sections. The ridge-like structural elements on the diaphragm then act like a dam which, with respect to the flow, decouples the area above the sound opening from the edge area, where the pressure compensation openings in the counterelement and the openings in the diaphragm structure are situated. Since the vents in this case make a much smaller contribution to the pressure compensation between the front side and the back side of the diaphragm, the ventilation of the back side of the diaphragm may be devised here largely independently of the pressure compensation between the front side and the back side of the diaphragm.

DETAILED DESCRIPTION OF THE INVENTION

Figure 1A:
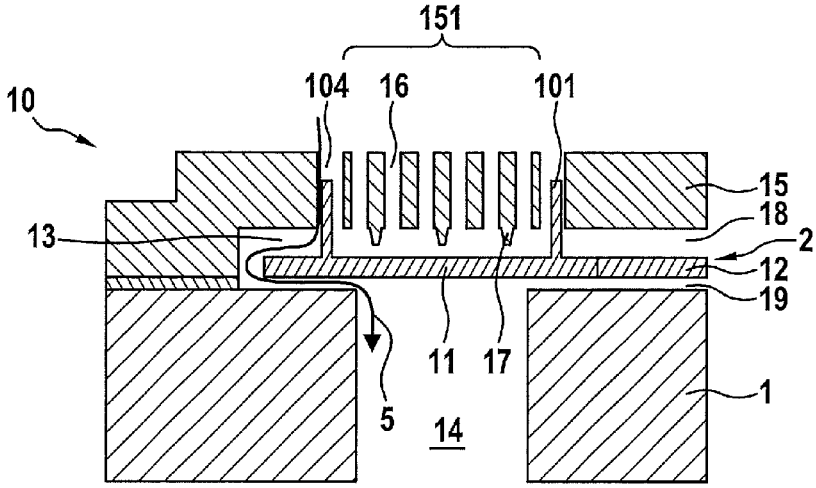
FIG. 1*a* shows a schematic sectional illustration of the microphone structure of a first component 10 according to the present invention.

Since the microphone structures of the three MEMS microphone components 10, 20, and 30 illustrated in the figures differ essentially only in the characteristics of the ridge-like structural elements 101, 201 and 202, and 301 and 302, respectively, the common features of these three microphone components 10, 20, and 30 are initially discussed in the following. Identical reference numerals are used for identical components.

In all three exemplary embodiments, the microphone structure is implemented in a layered structure on a semiconductor substrate 1. The microphone structure includes a diaphragm structure 2 which is provided in a relatively thin diaphragm layer above semiconductor substrate 1. This diaphragm layer may be composed of one or also multiple material layers. In this case, diaphragm structure 2 essentially includes a circular acoustically active diaphragm 11 and at least one spring element 12 via which diaphragm 11 is integrated into the layered structure of components 10, 20, and 30. Openings 13 between spring elements 12 and diaphragm 11 allow air exchange, and thus also pressure compensation, between the two sides of diaphragm 11.

Diaphragm 11 spans a cylindrical sound opening 14 in the back side of semiconductor substrate 1, the diameter of circular diaphragm 11 here in each case being larger than that of sound opening 14.

A stationary acoustically permeable counterelement 15 is situated in the layered structure above the diaphragm structure, and is provided with through openings 16 in the area above diaphragm 11. These through openings are used to ventilate the microphone structure, and thus contribute to the de-attenuation of microphone diaphragm 11. In addition, extensions 17 are provided on the surface of counterelement 15 facing diaphragm 11, which are intended to prevent electrostatic attraction of the diaphragm to counterelement 15.

The signal detection is carried out capacitively here. Diaphragm 11 functions as a deflectable electrode of a microphone capacitor whose stationary counter electrode is situated on counterelement 15.

According to the present invention, in all three microphone components 10, 20, and 30 illustrated here, diaphragm 11 is equipped with at least one ridge-like structural element 101, 201 and 202, and 301 and 302, respectively, which emerge(s) from the diaphragm plane. These structural elements 101, 201 and 202, and 301 and 302 in each case are situated at the outer edge area of diaphragm 11, and project into a corresponding recess 104, 204, and 303 and 304, respectively, in the layer on the other side of air gap 18 and 19 adjoining the particular diaphragm surface, so that sound-related diaphragm deflections are not hindered.

The characteristics and mode of operation of ridge-like structural elements 101, 201 and 202, and 301 and 302 are explained separately below for each of microphone components 10, 20, and 30, with reference to the respective figures.

Figure 1B:
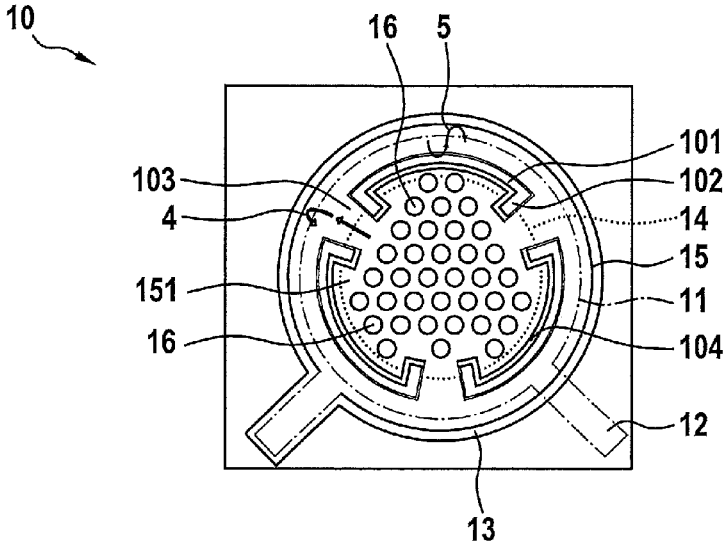
FIG. 1*b* shows a top view of the counterelement side of component 10.

Microphone component 10 illustrated in FIGS. 1*a* and 1*b* includes three ridge-like structural elements 101 which are formed on the diaphragm surface facing counterelement 15. Each structural element 101 is implemented in the form of a section of a circular circumferential wall which is situated above the edge area of sound opening 14 and at a lateral distance therefrom. Wall sections 101 are arrayed at a uniform distance from one another so that they form a circumferential wall having three openings 103. Ends 102 of individual wall sections 101 are each oriented radially with respect to sound opening 14, so that neighboring ends 102 of two adjacent wall sections 101 in each case form a flow channel 103 for the pressure compensation between the two sides of diaphragm 11.

FIG. 1*a* shows that ridge-like structural elements 101 protrude into correspondingly shaped slit-like pressure compensation openings 104 in counterelement 15, in particular, far enough that the structural elements bridge air gap 18 between diaphragm 11 and counterelement 15, even during the most extreme diaphragm deflections. In addition, ridge-like structural elements 101 are not situated centrally with respect to pressure compensation openings 104, but instead are offset radially outwardly. Pressure compensation openings 104 extend, in the same way as vents 16, over the entire thickness of counterelement 15. Ridge-like structural elements 101 and pressure compensation openings 104 surround center area 151 of counterelement 15, in which vents 16 are situated, so that the air flow between vents 16 on one side of diaphragm 11 and sound opening 14 on the other side of diaphragm 11 occurs essentially via flow channels 103. The flow path indicated by arrow 5 in FIG. 1*a* in this case makes only a minor contribution to the pressure compensation, not least because of the offset configuration of structural element 101 and pressure compensation opening 104.

The shape and configuration of the ridge-like structural elements and wall sections 101 having ends 102 which are oriented radially with respect to sound opening 14 are shown in particular in the top view in FIG. 1*b*. Arrow 4 indicates one of the flow paths which make the main contribution to the pressure compensation between the two sides of diaphragm 11.

Figure 2A:
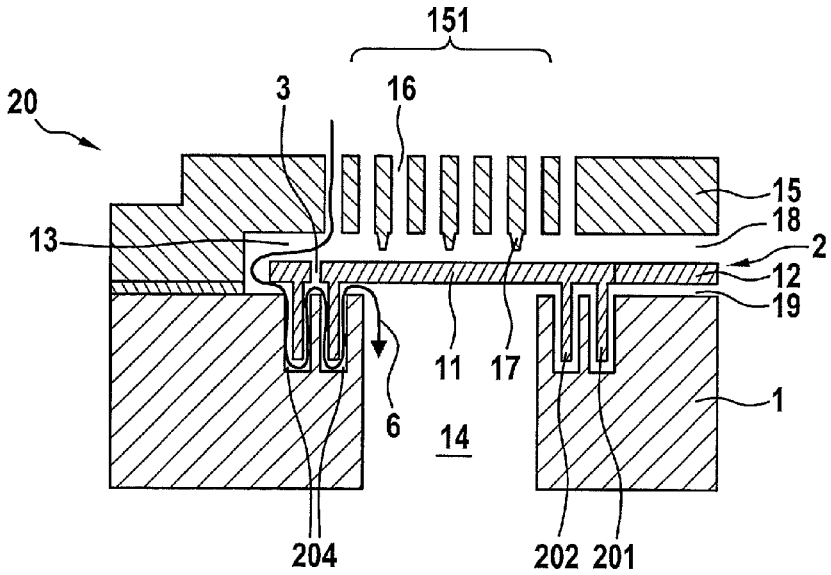
FIG. 2*a* shows a schematic sectional illustration of the microphone structure of a second component 20 according to the present invention.
Figure 2B:
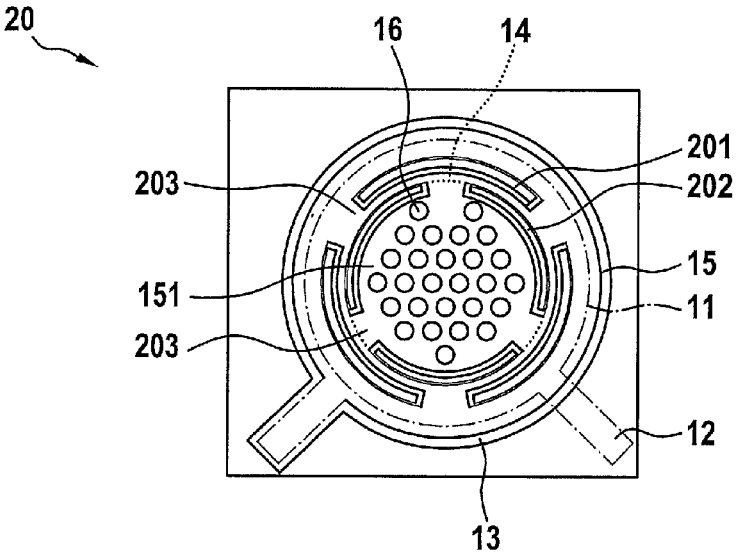
FIG. 2*b* shows a top view of the counterelement side of component 20.

Microphone component 20 illustrated in FIGS. 2*a* and 2*b* includes a total of six ridge-like structural elements 201 and 202 which are formed on the diaphragm surface facing sound opening 14. Three of these structural elements 201 and 202, respectively, form a circular wall formation as described above in conjunction with FIGS. 1*a* and 1*b*. The two wall formations 201 and 202 are situated concentrically with respect to one another above the edge area of sound opening 14 and at a lateral distance therefrom, in particular in such a way that openings 203 are positioned with an offset relative to one another in individual wall formations 201 and 202. This is shown in particular in the top view in FIG. 2*b*.

Ridge-like structural elements 201 and 202 protrude into correspondingly shaped trench-like recesses 204 in substrate 1, in particular, far enough that the structural elements bridge air gap 19 between diaphragm 11 and substrate 1, even during the most extreme diaphragm deflections. This is shown in particular in the cross-sectional illustration in FIG. 2*a*.

In contrast to the embodiment variant illustrated in FIGS. 1*a* and 1*b*, for the pressure compensation between the two sides of diaphragm 11, in any case flow must occur around at least one wall section 201 and/or 202. Arrow 6 describes such a flow path between vents 16 on one side of diaphragm 11 and sound opening 14 on the other side of diaphragm 11.

Etching openings 3 are present in diaphragm 11, between wall sections 201 and 202 of the two circular wall formations, which are used as etching channels for a sacrificial etching process for exposing structural elements 201 and 202. In the exemplary embodiment illustrated here, ridge-like structural elements 201 and 202 have been created which have a uniform width over their entire height.

With the aid of ridge-like structural elements 201 and 202, not only is a very good acoustic seal realized between the two sides of diaphragm 11, but at the same time, overload protection for diaphragm 11 on the substrate side is provided. For this purpose, the height of ridge-like structural elements 201 and 202 and the depth of corresponding trench-like recesses 204 in substrate 1 are dimensioned in such a way that the deflection of ridge-like structural elements 201 and 202, and thus also the deflection of diaphragm 11, is limited on the substrate side.

Figure 3A:
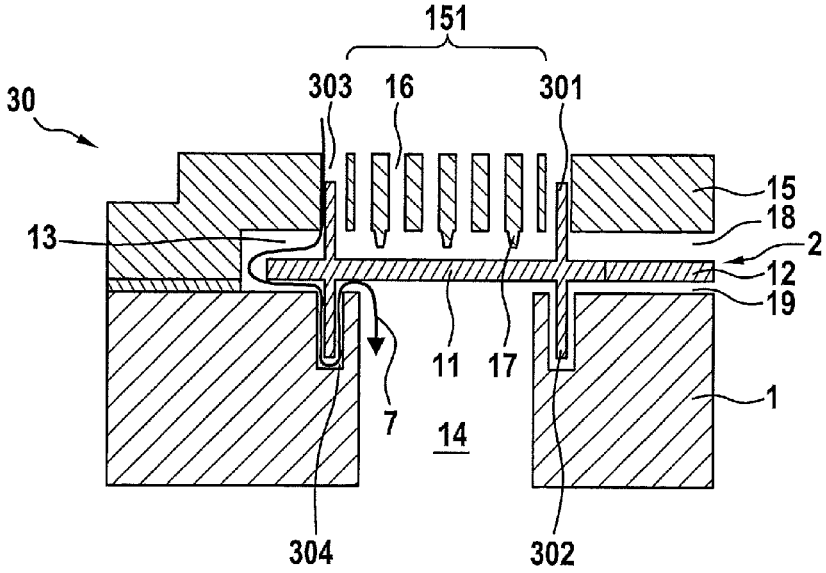
FIG. 3*a* shows a schematic sectional illustration of the microphone structure of a third component 30 according to the present invention.
Figure 3B:
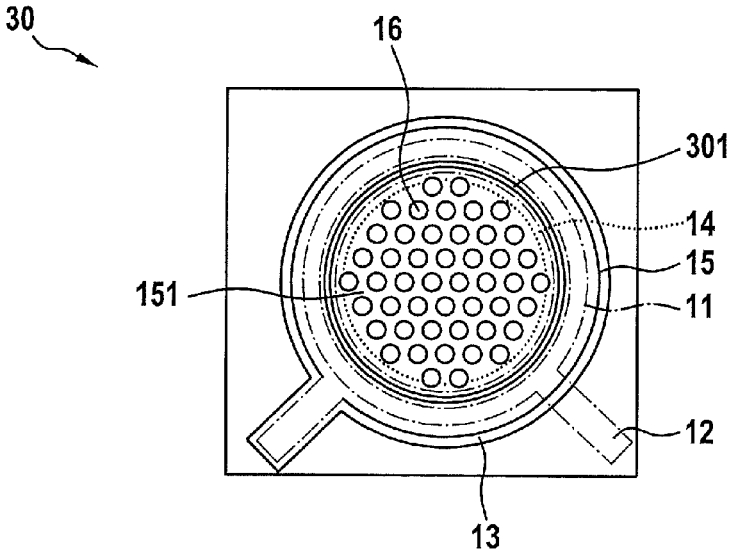
FIG. 3*b* shows a top view of the counterelement side of component 30.

Microphone component 30 illustrated in FIGS. 3*a* and 3*b* includes two ridge-like structural elements 301 and 302, each of which is implemented in the form of a closed circular wall. These structural elements are situated opposite one another on the two diaphragm surfaces, in particular above the edge area of sound opening 14 and at a lateral distance therefrom. The shape and configuration of the ridge-like structural elements and circular closed walls 301 and 302 are shown in particular in the top view in FIG. 3*b*. At this point it is noted that the two circular walls 301 and 302 could also be implemented with different diameters.

Structural element 301 protrudes into a circular slit-like pressure compensation opening 303 in counterelement 15 which surrounds center area 151 of counterelement 15, which is provided with vents 16. This circular pressure compensation opening 303 extends over only portions of the entire thickness of counterelement 15, as illustrated in FIG. 3*a*. In some sections (not illustrated here), pressure compensation opening 303 is implemented in the form of a trench-like recess in counterelement 15. On the one hand, a rigid connection of center area 151 to the layered structure is thus ensured. On the other hand, the trench-like sections of pressure compensation opening 303 together with structural element 301 form overload protection for diaphragm 11 on the back side.

FIG. 3*a* also illustrates that closed wall 302 protrudes into a corresponding circular trench-like recess 304 in substrate 1. As in the case of microphone component 20, recess 304 together with structural element 302 form overload protection for diaphragm 11 on the substrate side.

Both ridge-like structural elements 301 and 302 are dimensioned in such a way that they bridge air gap 18 between diaphragm 11 and counterelement 15 and air gap 19 between diaphragm 11 and substrate 1, even during the most extreme diaphragm deflections. Therefore, for the pressure compensation, flow must occur around both structural elements 301 and 302 between the two sides of diaphragm 11, as indicated by arrow 7 in FIG. 3*a*.

The above-described exemplary embodiments illustrate how the flow resistance during the pressure compensation between the two sides of an MEMS microphone diaphragm may be influenced in a targeted manner by varying design parameters of the micromechanical microphone structure. According to the present invention, the flow resistance is increased by ridge-like structural elements which are situated in the flow path as dam-like obstructions, and around which flow must occur during the pressure compensation. The flow path is thus on the one hand narrowed, and on the other hand extended in a targeted manner. These ridge-like structural elements are preferably circumferentially arranged at the outer edge area of the diaphragm.

What is claimed is:

1. A component having a micromechanical microphone structure configured as a layered structure on a semiconductor substrate, comprising:

a diaphragm structure having an acoustically active diaphragm which at least partially spans a sound opening in the back side of the substrate and is provided with a movable electrode of a microphone capacitor, wherein the diaphragm structure has openings via which pressure compensation occurs between the back side and the front side of the diaphragm;

a stationary acoustically permeable counterelement having vents, wherein the counterelement is situated in the layered structure above the diaphragm and functions as a carrier for a nonmovable electrode of the microphone capacitor;

wherein the diaphragm is provided with at least one ridge-like structural element which emerges from the diaphragm plane and is situated at an outer edge area of the diaphragm, and wherein the ridge-like structural element protrudes, even during sound-related diaphragm deflections, into a corresponding recess in a layer on an opposite side of an air gap adjoining the diaphragm surface, without hindering sound-related diaphragm deflections.

2. The component as recited in claim 1, wherein the at least one ridge-like structural element tapers as distance increases from the diaphragm plane.

3. The component as recited in claim 1, wherein the at least one ridge-like structural element is formed on the side of the diaphragm facing the counterelement, and the at least one ridge-like structural element protrudes into a correspondingly shaped pressure compensation opening in the counterelement.

4. The component as recited in claim 3, wherein at least one section of the ridge-like structural element on the side of the diaphragm facing the counterelement is configured to protrude into a correspondingly shaped and dimensioned trench-like recess in the counterelement, whereby said at least one section of the ridge-like structural element provides overload protection for the diaphragm.

5. The component as recited in claim 1, wherein the at least one ridge-like structural element is formed on the side of the diaphragm facing the sound opening and protrudes into a correspondingly shaped trench-like recess in the substrate.

6. The component as recited in claim 5, wherein the ridge-like structural element and the corresponding trench-like recess in the substrate are configured as overload protection for the diaphragm.

7. The component as recited in claim 3, wherein the at least one ridge-like structural element is configured as a closed circumferential wall which is situated above the edge area of the sound opening and at a lateral distance from the sound opening.

8. The component as recited in claim 7, wherein multiple ridge-like structural elements are provided, and wherein the ridge-like structural elements are each configured in the form of a wall section situated above the edge area of the sound opening and distributed at a lateral distance from the sound opening.

9. The component as recited in claim 8, wherein the ends of the ridge-like structural elements are oriented in the direction of the sound opening so that neighboring ends of two adjacent wall sections in each case form a flow channel.

10. The component as recited in claim 8, wherein the vent in the counterelement is situated above the diaphragm area which is surrounded by the wall sections.

* * * * *